US012607019B1

(12) United States Patent
Warford

(10) Patent No.: US 12,607,019 B1
(45) Date of Patent: Apr. 21, 2026

(54) UNIVERSAL WHEELCHAIR RAMP LANDING

(71) Applicant: Lawrence Eugene Warford, Bonney Lake, WA (US)

(72) Inventor: Lawrence Eugene Warford, Bonney Lake, WA (US)

( * ) Notice: Subject to any disclaimer, the term of this patent is extended or adjusted under 35 U.S.C. 154(b) by 530 days.

(21) Appl. No.: 18/199,913

(22) Filed: May 19, 2023

(51) Int. Cl.
*E04F 11/00* (2006.01)
*E04F 11/18* (2006.01)

(52) U.S. Cl.
CPC ..... *E04F 11/002* (2013.01); *E04F 11/18* (2013.01); *E04F 2011/007* (2013.01)

(58) Field of Classification Search
CPC .... E04F 11/002; E04F 11/18; E04F 2011/007
USPC ..... 14/69.5–72.5
See application file for complete search history.

(56) References Cited

U.S. PATENT DOCUMENTS 3,964,118 A * 6/1976 Meyers ..... B66F 7/08 14/71.3
4,473,916 A * 10/1984 Connold ..... B63B 27/14 14/42
4,517,698 A * 5/1985 Lamp'l ..... B64F 1/324 14/72.5
8,813,289 B1 * 8/2014 Clark ..... E04F 11/002 14/69.5
2004/0050010 A1 * 3/2004 Fortier ..... E04B 1/003 52/650.3
2009/0255066 A1 * 10/2009 Brock ..... E04F 11/181 52/7
2011/0232010 A1 * 9/2011 Peterson ..... E01D 18/00 14/71.1
2013/0198978 A1 * 8/2013 Pohlman ..... E01D 1/00 29/428
2014/0020978 A1 * 1/2014 Weston ..... E04G 1/34 182/102
2014/0352085 A1 * 12/2014 Larson ..... E01D 18/00 14/71.1
2022/0134242 A1 * 5/2022 Vamos ..... E06B 11/022 104/28

FOREIGN PATENT DOCUMENTS

CH 601569 A * 7/1978 ..... E04F 11/002
ES 2932478 A1 * 1/2023 ..... G09B 9/042
RU 186308 U1 * 1/2019 ..... E04H 6/40

* cited by examiner

*Primary Examiner* — Raymond W Addie
(74) *Attorney, Agent, or Firm* — Joseph Z. Ellsworth

(57) ABSTRACT

A universal wheelchair ramp landing that will allow the wheelchair ramp to extend at multiple angles depending on the need. The universal landing may be circular and allow an interface section to be attached at many locations to attain the desired angle. The wheelchair ramp would then extend from the interface portion.

20 Claims, 6 Drawing Sheets

UNIVERSAL WHEELCHAIR RAMP LANDING

BACKGROUND

Field of the Invention

This invention relates to ramps and more specifically to an adjustable and universal wheelchair ramp landing.

Prior Art

It is known to have wheelchair ramps. The American Disability Act (ADA) requires that wheelchair ramps be placed in all public entry ways, thus insuring entrance to all. Many older buildings may not have been designed to have a wheelchair ramp and therefore the angle of the building to the sidewalk is irregular. Also, there may be features around the building that must be avoided by the ramp requiring the ramp to extend at difficult and irregular angles.

SUMMARY

It is an objective of some example embodiments to address the problems in the prior art and provide a universal ramp that can extend at any angle and provide a landing that complies with the ADA with a high safety factor. These objectives are achieved in a portable wheelchair ramp comprising a landing that is adjustable to plurality of angles.

The universal wheelchair ramp landing will overcome the deficiencies in the prior art utilizing a circular landing coupled to a first interface section and a second interface section. The first interface section is configured to couple the circular landing to another structure such as a building or to be free standing adjacent to a building. A first modular railing fits between the first interface section, and the second interface section and a second modular railing fits between the first interface section, and the second interface section on the opposite side of the circular landing.

A method of assembling a universal wheelchair ramp includes coupling a circular landing to a first interface section and a second interface section at a desired angular configuration. The angular configuration is determined by the landscape or the requirements of the law. Then, coupling a first modular railing between the first interface section, and the second interface section, and then coupling a second modular railing between the first interface section, and the second interface section on the opposite side of the circular landing.

DETAILED DESCRIPTION

Figure 1:
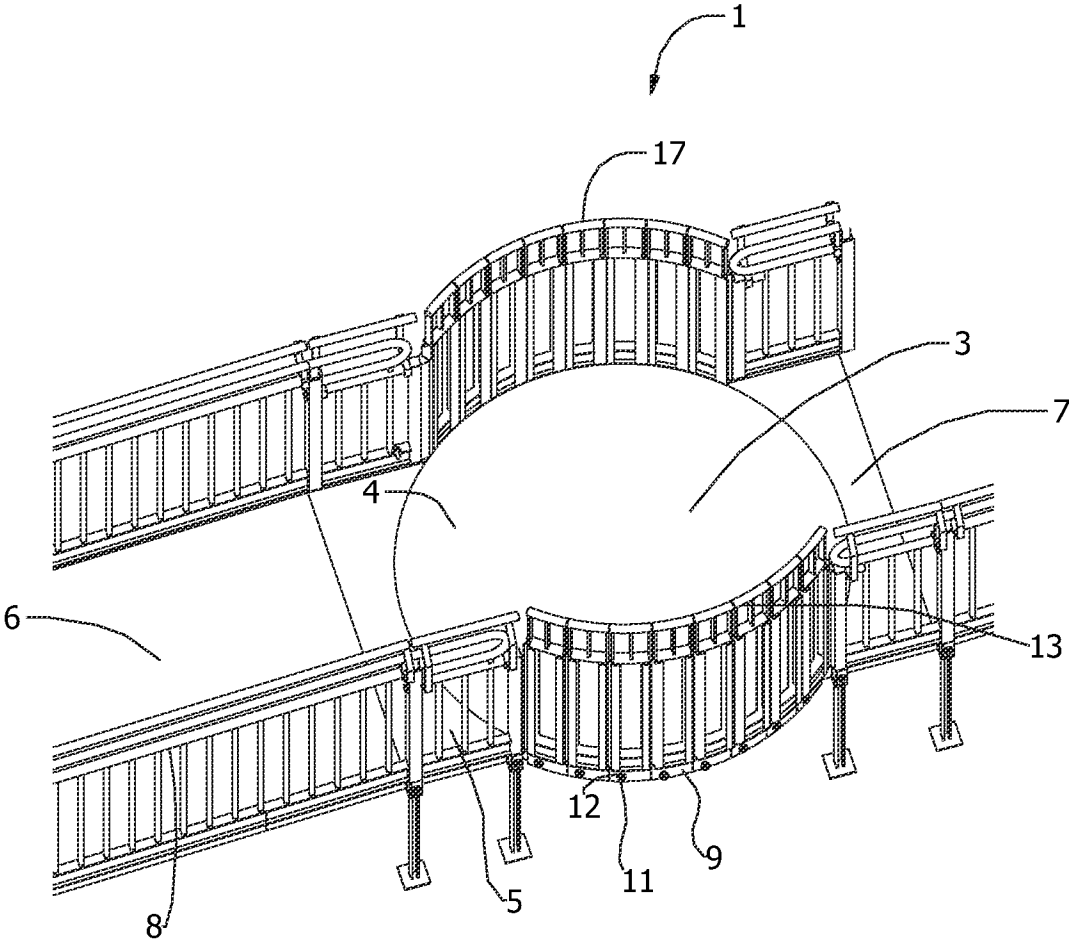
FIG. 1 is a perspective view of a wheelchair ramp landing according to an embodiment of the present invention.

A universal landing 1 is intended to provide a plurality of available angles that a wheelchair ramp may extend away from a building. The universal landing 1 also provides smalls angle adjustment allowing for very precise plan form ramp angle to meet the building requirements. A circular landing 3 allows for the adjustment at very small angles but other shapes such as polygons may be used to achieve an adequate angle adjustment. The circular landing 3 has a landing deck 4 that interfaces with wheelchairs and is large enough for a wheelchair to turn around as required by the ADA. A first interface section 5 provides an interface between a circular landing 3 and a ramp section 6 or a building. A second interface section 7 also provides an interface between a circular landing 3 and a ramp section 6 or a building. If the second interface section 7 interfaces with a building, then most likely the first interface section 5 interfaces with ramp section 6 to allow a user out of the building. Ramp section 6 has a ramp railing section 8 attached to provide safety to users of the ramp. The first and second interface section 5, 7 may be concave circle on one side and flat on the opposite side. In some instances, the first interface section 5 may be combined with the circular landing 3 to conserve parts. If the first interface section 5 and circular landing 3 are combined, then all angular adjustment is achieved with the placement of the second interface section 7. The circular landing 3 has a side portion that is a railing to landing interface 9. The railing to landing interface has a landing aperture 11 and it is configured to align with a railing aperture 12. The first modular railing 13 is sized to fit between the first interface section 5 and the second interface section 7. A second modular railing 17 fits on the opposite side of the circular landing and takes up the space between interface sections. The distance between the first and second interface section 5,7 changes depending on the angle to be achieved in the circular landing and the placement of the interface sections around the circumference. The modular railings 13, 17 must be infinitely adjustable or at least as adjustable as the interface sections 5, 7.

Figure 2B:
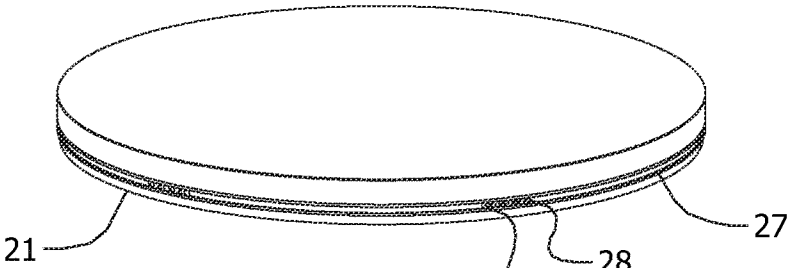
FIG. 2*b* is a perspective view of a circular landing having a landing channel.
Figure 2:
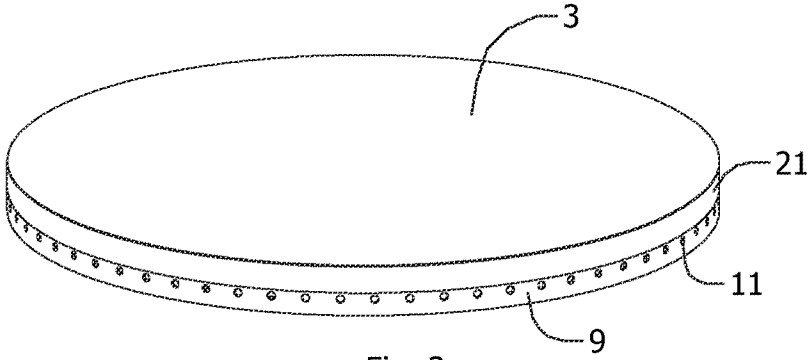
FIG. 2 is a perspective view of a circular landing.

In FIG. 2, the circular landing 3 is shown as a single part with a railing to landing interface 9 and the landing aperture 11 in the landing facia 21. The circular landing is preferably circular but could be any polygon.

Figure 2A:
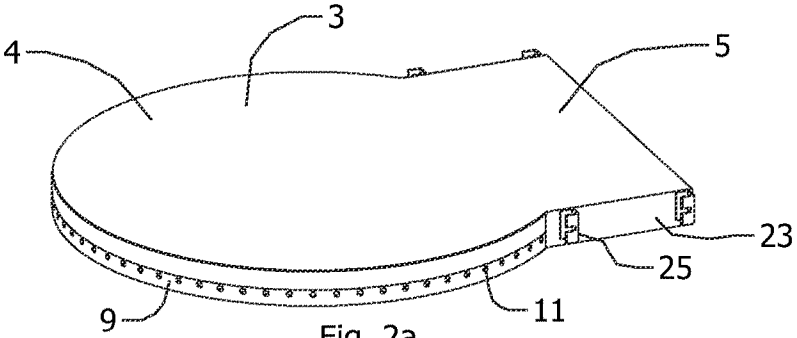
FIG. 2*a* is a perspective view of a circular landing integral with an interface section.

In FIG. 2*a*, a circular landing is shown with an integral second interface section 5. The integral second interface section 5 has an interface facia 23 on its side. Attached to the interface facia is a railing connector 25.

FIG. 2*b* shows a circular landing that comprises a landing channel 27 in the landing facia 21. The landing channel 27 holds a plurality of square nuts 29 they can slide freely around the channel and can be bolted in an any location around the circumference. The landing apertures of FIG. 2 are in many precise locations and the square nuts of FIG. 2*b* can be moved in the landing channel 27 to the same locations to be coincident with the railing apertures 12.

Figure 3:
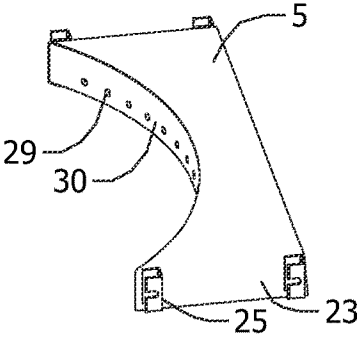
FIG. 3 is a perspective view of an interface section.

FIG. 3 is a detailed view of an example first interface section 5. The first interface section 5 has an interface section facia 23 and railing connector 25 connected to it. The first interface section 5 has a landing interface side 30 with a concave circular shape configured to mate with the circular landing 3. The landing interface side 30 may also have interface section apertures that are configured to be concentric with landing apertures 11. The other three sides of the interface section 5, 7 are preferably at right angles to each other.

Figure 4:
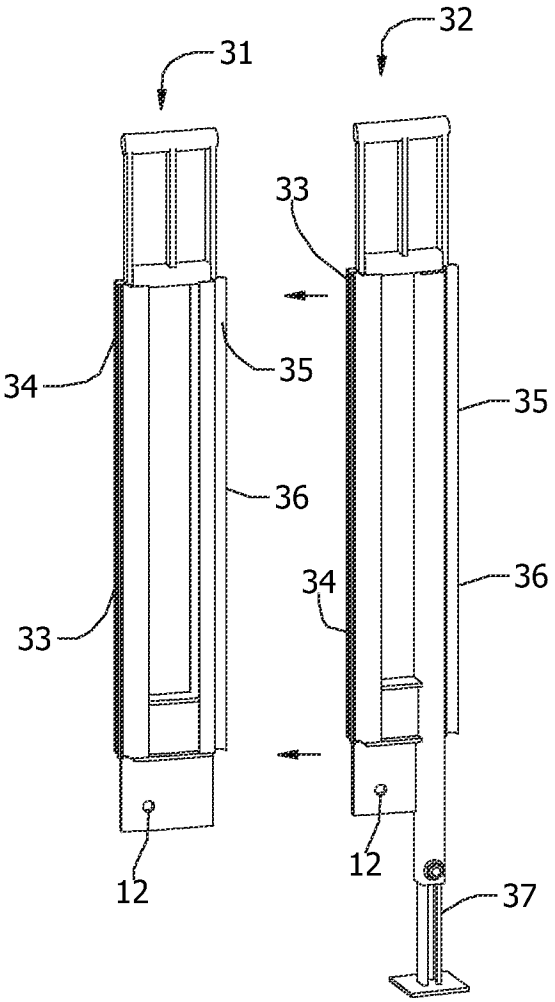
FIG. 4 is a perspective view of a landing railing segment and a landing combined railing-leg segment showing how they can fit together.

FIG. 4 has a detailed view of the landing railing segment 31 and the landing combined railing and leg segment 32. Both segments have a male J-hook connector 33 on the first edge 34 and a female J-hook connector 35 on the second edge 36. In practice the landing railing segments 31 connect to each other with the male J-hook connector being placed in the female J-hook connector and then fastened to the circular landing 3 through the railing aperture 12 and through the landing aperture 11. In some instances, the landing will need to be supported and a landing combined railing and leg segment 32 can be inserted into the modular railing stack up. The landing combined railing and leg segment has an adjustable leg 37 that can be extended to the ground to support the weight of the landing 3.

Figure 5:
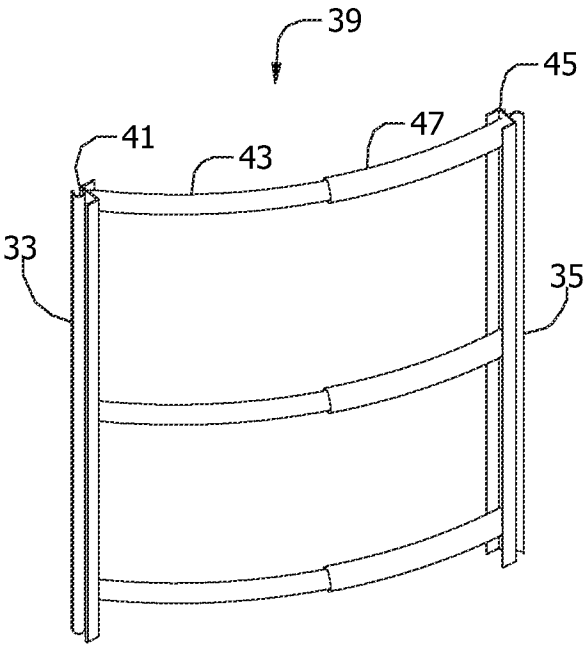
FIG. 5 is a perspective view of an assembled cut to length railing section.

FIG. 5 is a depiction of a fully adjustable one-piece railing. The railing is a cut to length railing 39. The cut to length railing 39 has a first cut section 41 further comprising a small rail portion 43. A second cut section 45 has a large rail portion 47 that slides over the small rail portion 43. The small rail portion 43 and the large rail portion 47 have the same radius curvature in the same plane allowing the small rail portion 43 to slide entirely into the large rail portion 47 if needed. In practice the landing 3 is setup to meet the required ramp angle and then the large and small rail portions 43, 47 are cut to length to fill gap between the first interface section 5 and the second interface section 7. The large and small rail portion 43, 47 are cut so that a substantial portion of the small rail section is within the large rail portion 47 to support the loading requirements. The first cut section 41 also has a male J-hook connector which is configured to attach to a railing section. The second cut section 45 has a female J-hook connector 35 that attaches to another railing section.

Figure 6:
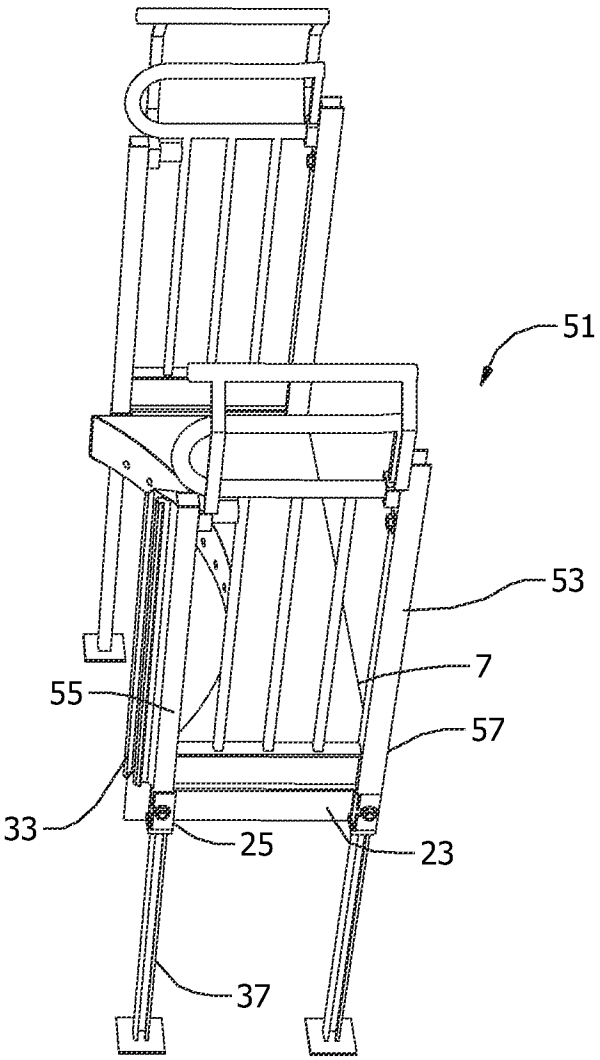
FIG. 6 is a perspective view of a first and second interface section with the interface section railing installed.
Figure 6:
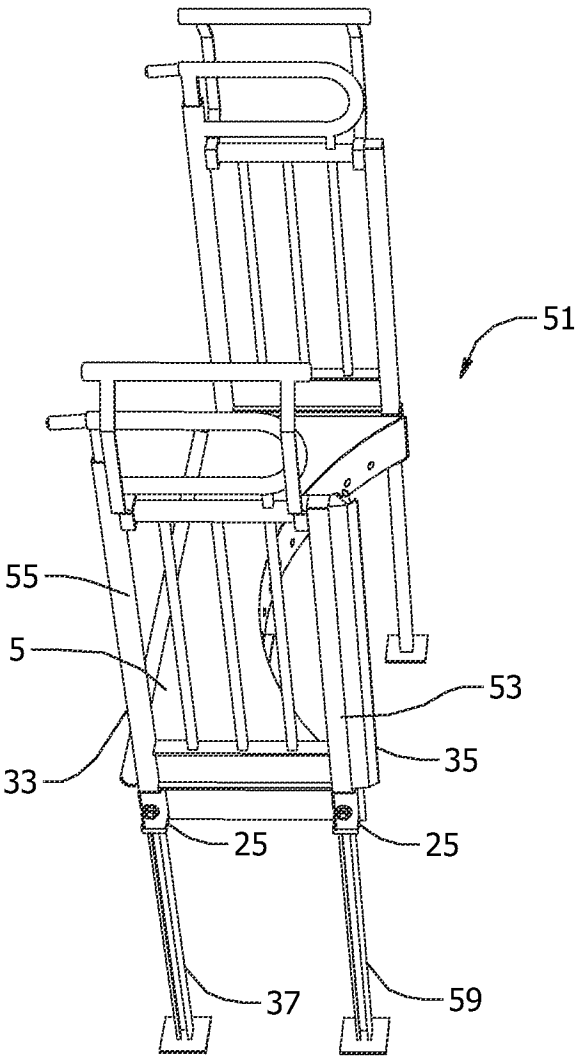

FIG. 6 illustrates a more complete version of the first and second interface sections 5,7 with interface section railings 51 attached. The interface section railing 51 has a first side 53 and a second side 55. The interface section railing first side 53 may be attached to a wall at a railing wall interface 57. This usually means no J-hook connector; just the square tube so it can be fastened to a building. The interface section railing second side 55 may have a male J-hook connector 33 and an adjustable leg 37. In some configurations where the interface railing 51 does not connect to a wall it is necessary to have an interface section railing second leg 59 to fully support the structure. In cases where the interface section railing is not connected to a wall the railing first side may have a female J-hook connector 35

Figure 7:
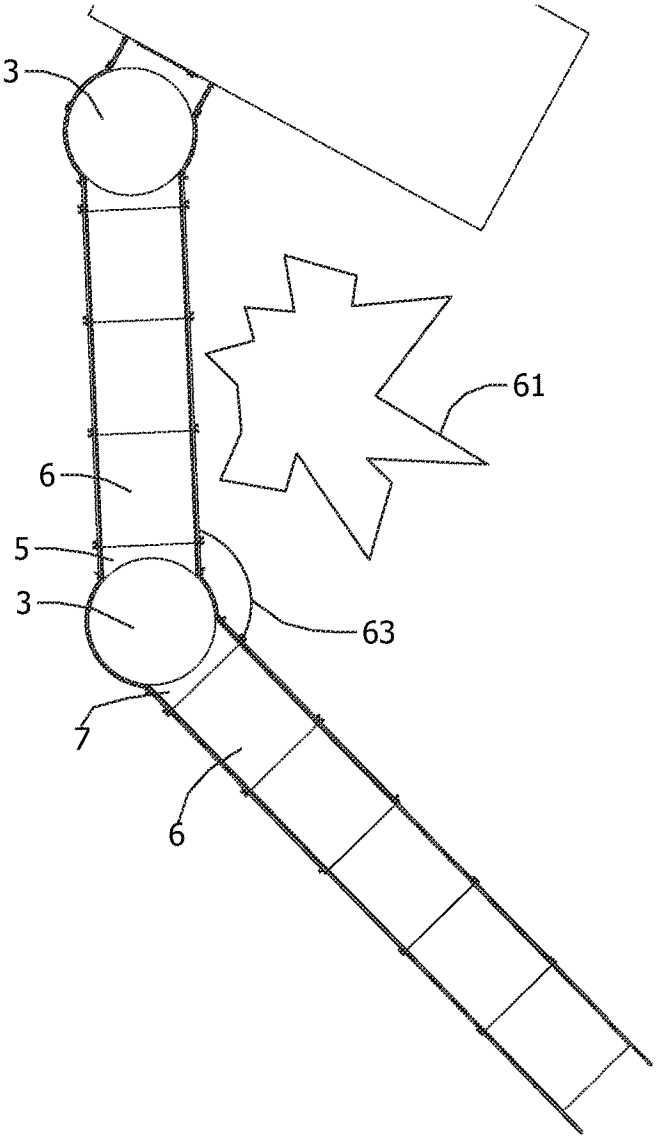
FIG. 7 is a plan view of an example wheelchair ramp landing.

FIG. 7 is a plan form view of an embodiment of the wheelchair ramp assembly. The wheelchair ramp extends perpendicularly away from a building to the first circular landing 3. An object that must be avoided 61 prevents a typical right-angle landing from being utilized. Therefore, an alternate planform angle 63 must be used to avoid the object 61. The circular landing 3 can make many planform angles 63 between the first interface section 5 and the second interface section 7. The range of planform angles 63 is between 90 degrees and 270 degrees.

Figure 8:
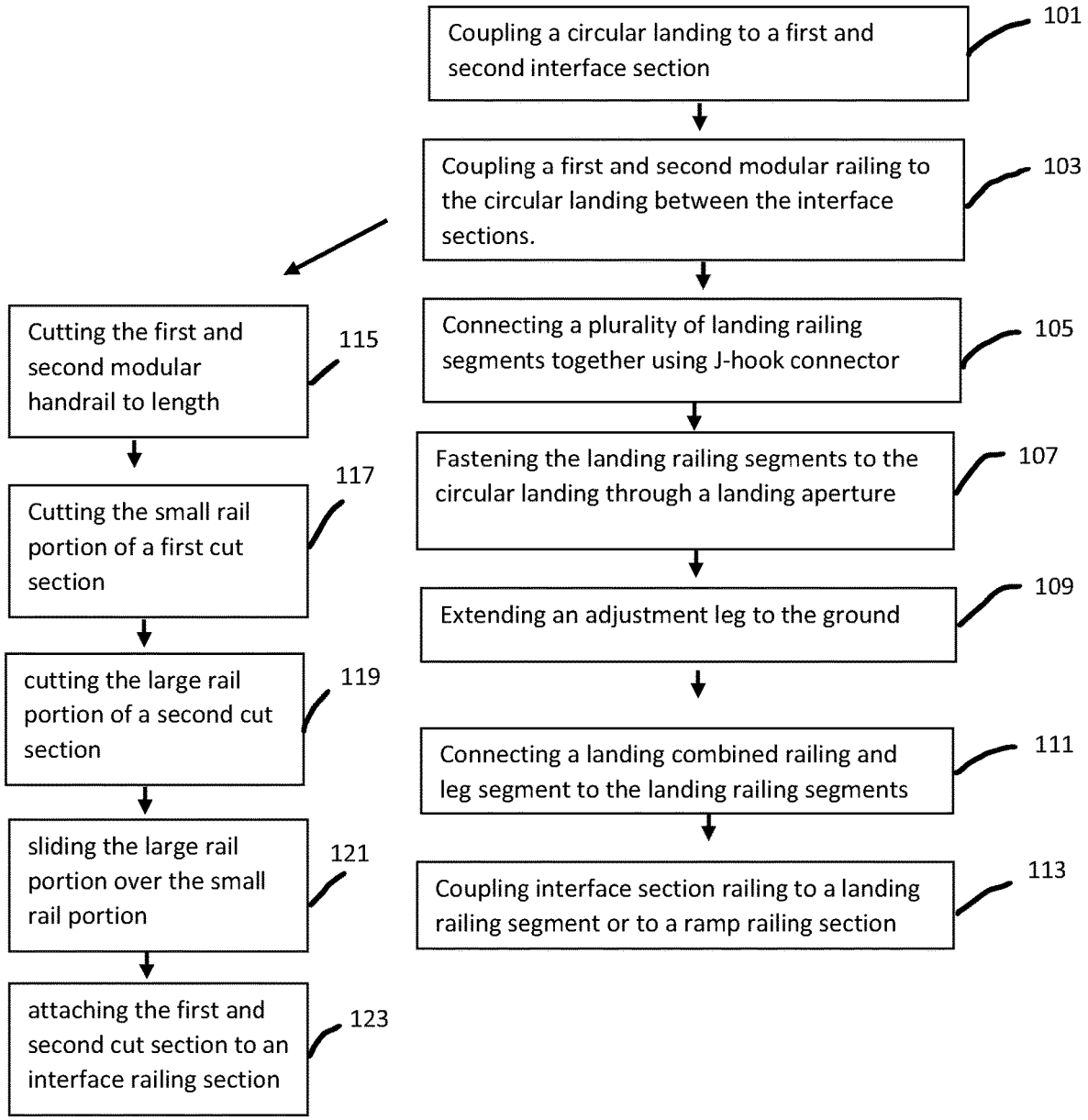
FIG. 8 is a flow diagram for the assembly of the wheelchair ramp universal landing.

A further embodiment of the invention is a method of assembling a universal wheelchair ramp and is shown in FIG. 8. The method comprises coupling a circular landing 3 to a first interface section 5 and a second interface section 7 at a desired angular configuration 101. The angular configuration is the plan form angle of where the installer wants the path to extend. Next step is coupling a first modular railing 13 between the first interface section 5, and the second interface section 7 and, coupling a second modular railing 17 between the first interface section 5, and the second interface section 7 on the opposite side of the circular landing 103. The assembly of the modular railings comprises, connecting a plurality of landing railing segments 31 to each other with a male J-hook connector 33 being placed in a female J-hook connector 35 of an adjacent landing railing segment 31, 105 and fastening the railing segments 31 to the circular landing 3 through a railing aperture 12 and a landing aperture 11, 107. A further step in the method is extending an adjustable leg 37, slidably attached to a landing combined railing and leg segment 32, to the ground to support the weight of the wheelchair ramp 1, 109 and connecting the landing combined railing and leg segment 32 to the plurality of landing railing segments 31, 111. Then, coupling a plurality of interface section railings 51 to the first and second interface sections 5,7. Next, attaching an interface section railing first side 53 to one of a wall and a ramp railing section 8, and then connecting the interface section railing second side 55 to a landing railing segment 31, 113. One railing configuration requires cutting to fit on the job. That process comprises, cutting the first and second modular railing 41, 45 to length 115 by, cutting a small rail portion 43 of a first cut section 41, 117, cutting a large rail portion 47 of a second cut section 45, 119 and then sliding the large rail portion 47 over the small rail portion 43, 121. Then attaching the first cut section 41 to an interface railing section 31 and attaching the second cut section 45 to another interface railing section 31, 123.

I claim:

1. A universal wheelchair ramp landing comprising, a circular landing, a first interface section and a second interface section wherein, the first interface section is configured to couple the circular landing to another structure, a first modular railing configured to fit between the first interface section, and the second interface section, a second modular railing configured to fit between the first interface section, and the second interface section on an opposite side of the circular landing, a landing channel in a landing facia of the circular landing, wherein the landing channel is configured to hold a plurality of square nuts that can slide freely around the landing channel.

2. The universal wheelchair ramp landing of claim 1 further comprising, the first interface section having a concave landing interface first side and, a landing interface second side configured to attach to a building or other permanent structure.

3. The universal wheelchair ramp landing of claim 1 further comprising, the second interface section having a concave landing interface first side and, a landing interface second side configured to attach to ramp section.

4. The universal wheelchair ramp landing of claim 1 wherein, the circular landing is a polygon.

5. The universal wheelchair ramp landing of claim 1 wherein, the first interface section is combined with the circular landing.

6. The universal wheelchair ramp landing of claim 1 further comprising, a railing to landing interface further comprising a landing aperture configured to align with a railing aperture in a landing railing segment.

7. The universal wheelchair ramp landing of claim 1 further comprising, a plurality of landing railing segments comprising a male J-hook connector on a first edge and a female J-hook connector on a second edge, wherein the plurality of landing railing segments are configured to connect to each other with the male J-hook connector being placed in the female J-hook connector, and at least one fastener couples the railings segments through to the circular landing through a railing aperture and a landing aperture.

8. The universal wheelchair ramp landing of claim 7 further comprising, a landing combined railing and leg segment configured to connect to the plurality of landing railing segments, the landing combined railing and leg segment further comprising, an adjustable leg configured to be extended to a ground surface to support the wheelchair ramp.

9. The universal wheelchair ramp landing of claim 1 wherein, the first and second modular railing is a cut to length railing further comprising, a first cut section further comprising a small rail portion, a second cut section further comprising a large rail portion configured to slide over the small rail portion.

10. The universal wheelchair ramp landing of claim 9, wherein the first cut section also has a male J-hook connector that is configured to attach to an interface railing section, and the second cut section has a female J-hook connector that is configured to attach to another interface railing section.

11. The universal wheelchair ramp landing of claim 1 further comprising, a plurality of interface section railings, the plurality of interface section railing comprises a first side and a second side, the interface section railing first side is configured to be attached to one of a wall and a ramp railing section.

12. The universal wheelchair ramp landing of claim 11 further comprising, a male J-hook connector protruding from the interface section railing second side configured to attach to a landing railing segment.

13. The universal wheelchair ramp landing of claim 11 further comprising, an adjustable leg extending from the interface section railing second side optionally, an adjustable leg extends from the interface section railing first side.

14. A method of assembling a universal wheelchair ramp comprising the steps of:

coupling a circular landing to a first interface section and a second interface section at a desired angular configuration, coupling a first modular railing between the first interface section, and the second interface section, coupling a second modular railing between the first interface section, and the second interface section on an opposite side of the circular landing, connecting a plurality of landing railing segments to each other with a male J-hook connector being placed in a female J-hook connector of an adjacent landing railing segment, and fastening the plurality of railings segments to the circular landing through a railing aperture and a landing aperture.

15. The method of claim 14 further comprising, extending an adjustable leg, slidably attached to a landing combined railing and leg segment, to a ground surface to support the universal wheelchair ramp, connecting the landing combined railing and leg segment to the plurality of landing railing segments.

16. The method of claim 14, further comprising, coupling a plurality of interface section railings to the first and second interface sections, attaching an interface section railing first side to one of a wall and a ramp railing section, and connecting the interface section railing second side to a landing railing segment.

17. The method of claim 14 further comprising, cutting the first and second modular railing to length by, cutting a small rail portion of a first cut section, cutting a large rail portion of a second cut section, sliding the large rail portion over the small rail portion, attaching the first cut section to an interface railing section, and attaching the second cut section to another interface railing section.

18. A universal wheelchair ramp landing comprising, a circular landing, a first interface section and a second interface section wherein, the first interface section is configured to couple the circular landing to another structure, a first modular railing configured to fit between the first interface section, and the second interface section, a second modular railing configured to fit between the first interface section, and the second interface section on an opposite side of the circular landing, a landing interface first side comprising interface section apertures configured to be concentric with landing apertures as the landing interface section first side is placed around the circular landing.

19. The universal wheelchair ramp landing of claim 18 further comprising, a plurality of landing railing segments comprising a male J-hook connector on a first edge and a female J-hook connector on a second edge, wherein the plurality of landing railing segments are configured to connect to each other with the male J-hook connector being placed in the female J-hook connector, and at least one fastener couples the railings segments through to the circular landing through a railing aperture and a landing aperture.

20. The universal wheelchair ramp landing of claim 19 further comprising, a landing combined railing and leg segment configured to connect to the plurality of landing railing segments, the landing combined railing and leg segment further comprising, an adjustable leg configured to be extended to a ground surface to support the wheelchair ramp.

* * * * *